US007293296B1

(12) United States Patent
Beraznik et al.

(10) Patent No.: US 7,293,296 B1
(45) Date of Patent: Nov. 13, 2007

(54) FOOTBALL GLOVE AND METHOD OF USE

(75) Inventors: Jeffrey M. Beraznik, 4344 E. Piccadilly Rd., Phoenix, AZ (US) 85018; Brian K. Makela, Liberty Township, OH (US)

(73) Assignee: Jeffrey M. Beraznik, Phoenix, AZ (US)

( * ) Notice: Subject to any disclaimer, the term of this patent is extended or adjusted under 35 U.S.C. 154(b) by 468 days.

(21) Appl. No.: 10/698,793

(22) Filed: Oct. 31, 2003

(51) Int. Cl.
*A41D 71/14* (2006.01)

(52) U.S. Cl. ..... 2/161.1; 2/21; 2/163

(58) Field of Classification Search ..... 2/161.1, 2/163, 164, 160, 161
See application file for complete search history.

(56) References Cited

U.S. PATENT DOCUMENTS 4,295,229 A * 10/1981 Clark et al. ..... 2/20
4,598,429 A * 7/1986 Mulvaney ..... 2/161.4
RE32,287 E 11/1986 Willis
4,958,384 A 9/1990 McCrane
5,018,221 A 5/1991 Romandetto
5,027,439 A 7/1991 Spector
5,136,725 A 8/1992 Montero
5,316,294 A * 5/1994 Turangan ..... 473/573
5,483,698 A 1/1996 Douglas, Jr.
5,638,548 A 6/1997 Kawakami
5,720,047 A 2/1998 Spitzer
5,758,365 A 6/1998 Steeley
5,809,571 A 9/1998 Spitzer
5,970,521 A * 10/1999 Rabbeth ..... 2/161.1
6,010,473 A 1/2000 Robinson
6,557,177 B2 * 5/2003 Hochmuth ..... 2/159
6,725,466 B2 * 4/2004 Hochmuth ..... 2/161.1
7,143,447 B2 * 12/2006 Fleischmann ..... 2/16

* cited by examiner

*Primary Examiner*—Katherine Moran
*Assistant Examiner*—Richale L Haney
(74) *Attorney, Agent, or Firm*—Jennings Strouss & Salmon PLC

(57) ABSTRACT

A football glove and method of use that protects a player's digits from hyperextending without impairing the player's ability to grasp objects and other players includes a hand covering portion for covering a palm and back of a user's hand. A plurality of form fitting finger receiving receptacles extend from the hand covering portion, and are in communication with the hand covering portion, each of the finger receiving receptacles includes a front and a back for receiving therebetween a finger of the user's hand covered by the hand covering portion. A unidirectional stiffener is fixed relative to at least one of the finger receiving receptacles adjacent the back of the at least one finger receiving receptacle, and extends toward the hand covering portion. The unidirectional stiffener is bendable toward the front of the at least one finger receiving receptacle to allow the user's finger to naturally curl toward the user's palm, and is substantially rigid in an opposing direction to prevent hyperextension of the user's finger.

20 Claims, 4 Drawing Sheets

FOOTBALL GLOVE AND METHOD OF USE

CROSS REFERENCES TO RELATED APPLICATIONS

Not Applicable

STATEMENT REGARDING FEDERALLY SPONSORED RESEARCH

Not Applicable

BACKGROUND OF THE INVENTION

The invention relates to football gloves, and more particularly to football gloves for preventing hyperextension of fingers and a method of use.

A football player blocks a defender by pushing the defender with one or more of his hands in a desired direction. The rules of football require that an offensive player's hands must be open (i.e. not in a clenched fist configuration) when blocking. The defender typically attempts to thwart the efforts of the offensive player by pushing the offensive player's hands away. If the defender pushes on the offensive player's digits (i.e. fingers and/or thumbs), the fingers and/or thumbs can be pushed backward beyond their normal range of motion which can result in hyperextension of the players digits and cause injury.

One method of protecting the offensive player's digits is to tape the digits together. The combined strength of the taped digits reduces the potential for injury to any one digits. Unfortunately, taping the offensive player's digits reduces the range of motion and functionality of the offensive player's hands, such as the ability of the offensive player to grasp an object, such as a football, or another player. Football gloves are also available that protect a player's hands from injury, such as when the hand is stepped on. These gloves, however, do not provide any protection for hyperextension of a player's fingers.

The rules of football specify that an offensive player can grasp another player carrying the football and can recover loose footballs. Therefore, having the ability to grasp objects and other players is an important function of the offensive player's hands, in addition to the need for protection from injury. Accordingly, a need exists for protecting an offensive player's digits from hyperextending without impairing the offensive player's ability to grasp objects and other players.

SUMMARY OF THE INVENTION

The present invention provides a football glove and a method of use that protects a player's digits from hyperextending without impairing the player's ability to grasp objects and other players. The glove includes a hand covering portion for covering a palm and back of a user's hand. A plurality of form fitting finger receiving receptacles extend from the hand covering portion, and are in communication with the hand covering portion, each of the finger receiving receptacles includes a front and a back for receiving therebetween a finger of the user's hand covered by the hand covering portion. A unidirectional stiffener is fixed relative to at least one of the finger receiving receptacles adjacent the back of the at least one finger receiving receptacle, and extends toward the hand covering portion. The unidirectional stiffener is bendable toward the front of the at least one finger receiving receptacle to allow the user's finger to naturally curl toward the user's palm, and is substantially rigid in an opposing direction to prevent hyperextension of the user's finger.

A general objective of the present invention is to provide a football glove and method of use that protects a player's digits from hyperextending without impairing the player's ability to grasp objects and other players while playing football. This objective is accomplished by providing a football glove having unidirectional stiffeners which prevent an opposing player from bending a user's fingers backward until they are hyperextended while allowing the fingers to flexion.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE INVENTION

Figure 1:
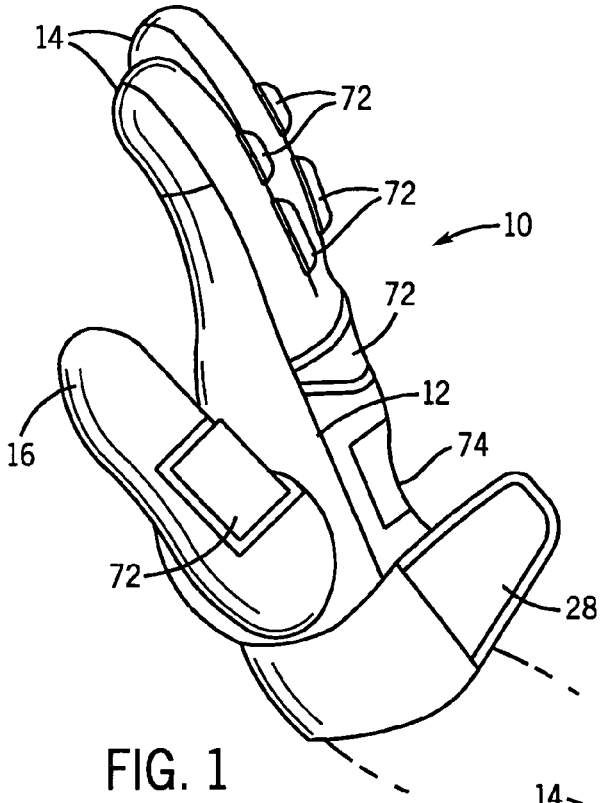
FIG. 1 is a perspective view of a football glove incorporating the present invention.

As shown in FIGS. 1-4, a football glove 10 for use by a football player during a football game is shown. The glove 10 includes a hand covering portion 12 for covering the player's palm and hand back, four finger receiving receptacles 14 for receiving the player's fingers, and a thumb receiving receptacle 16 for receiving the player's thumb. The football player's fingers and thumb are protected from hyperextension by unidirectional stiffeners 18. Each stiffener 18 is fixed relative to one of the receptacles to prevent the fingers and thumb from bending backwards.

The hand covering portion 12 covers a user's hand, and includes a palm cover 20 covering the user's palm and a back hand cover 22 covering the user's hand back. Preferably, the palm and back hand covers 20, 22 are formed from one or more layers of material, such as lycra, leather, neoprene, nylon, synthetic leather, and the like, and are joined by methods known in the art, such as sewing, knitting, and the like, to form a cavity 24 for receiving the user's hand. In one embodiment, the palm cover 20 includes an outwardly facing high abrasion resistant tacky material to enhance gripping.

In the embodiment disclosed herein, the hand covering portion 12 includes a wrist support portion 26 which wraps around the user's wrist to provide wrist support and secure the glove 10 to the user's hand. Preferably, a flap 28 extending tangential to the wrist support portion 26 has one end 30 fixed to the wrist support portion 26 and a free end 32. The free end 32 wraps around the wrist, and is fixed to the wrist support portion 26 by a hook and loop material, such as Velcro. Of course, other fasteners, such as snaps, zippers, and the like, can be used to fix the free end of the flap to the wrist support portion or secure the glove to the user's hand without departing from the scope of the invention. Moreover, a wrist support portion is not necessary to practice the invention.

The finger and thumb receiving receptacles 14, 16 extend from the hand covering portion 12 away from the wrist support portion 26, and are in communication with the cavity 24 for receiving the user's fingers and thumb. Preferably, the receptacles 14, 16 include a receptacle front 34 formed of neoprene, or other suitable material, such as the same material as the palm cover 20, and a receptacle back 36 formed of the same material as the back hand cover 22. Most preferably, the finger and thumb receptacles 14, 16 do not have excess material between the adjacent fingers and thumb, such as soccer goalie gloves, so as not to restrict flexion of the fingers and thumbs.

The receptacle fronts 34 and backs 36 are joined together, using methods known in the art, such as sewing. Each finger is received in one of the finger receiving receptacles 14 which fits snugly around the user's finger to firmly fix the fingers relative to the adjacent stiffener 18, such that the user's finger are limited to the motion allowed by the stiffener. Likewise, the user's thumb is received in the thumb receiving receptacle 16 which fits snugly around the user's thumb to firmly fix the thumb relative to the adjacent stiffener.

Figure 2:
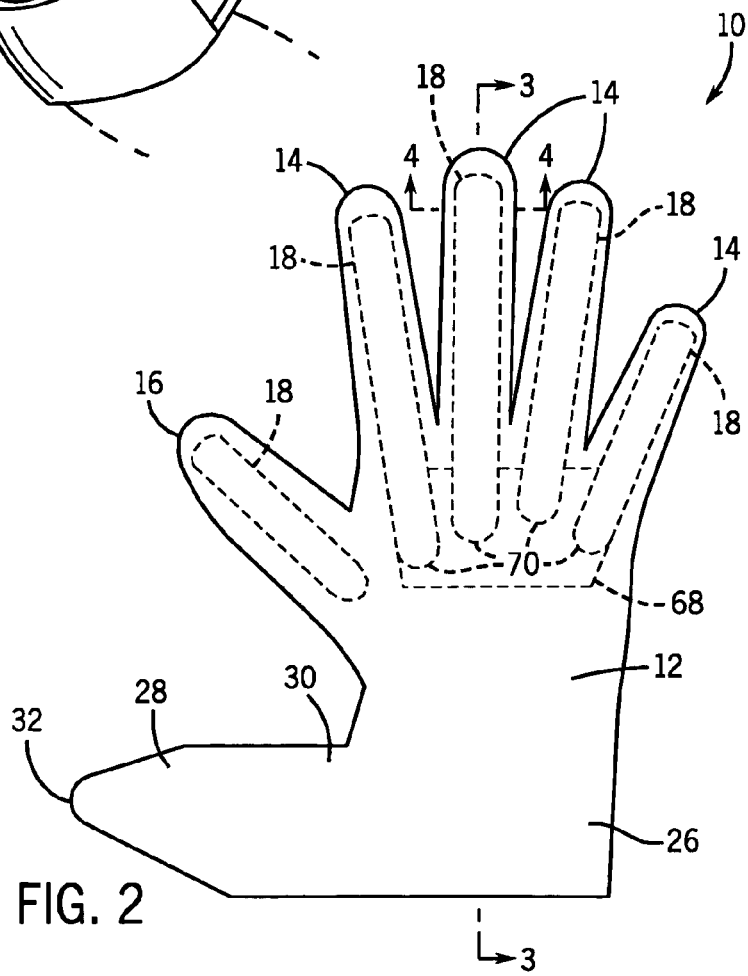
FIG. 2 is a plan view of the glove of FIG. 1.
Figure 3:
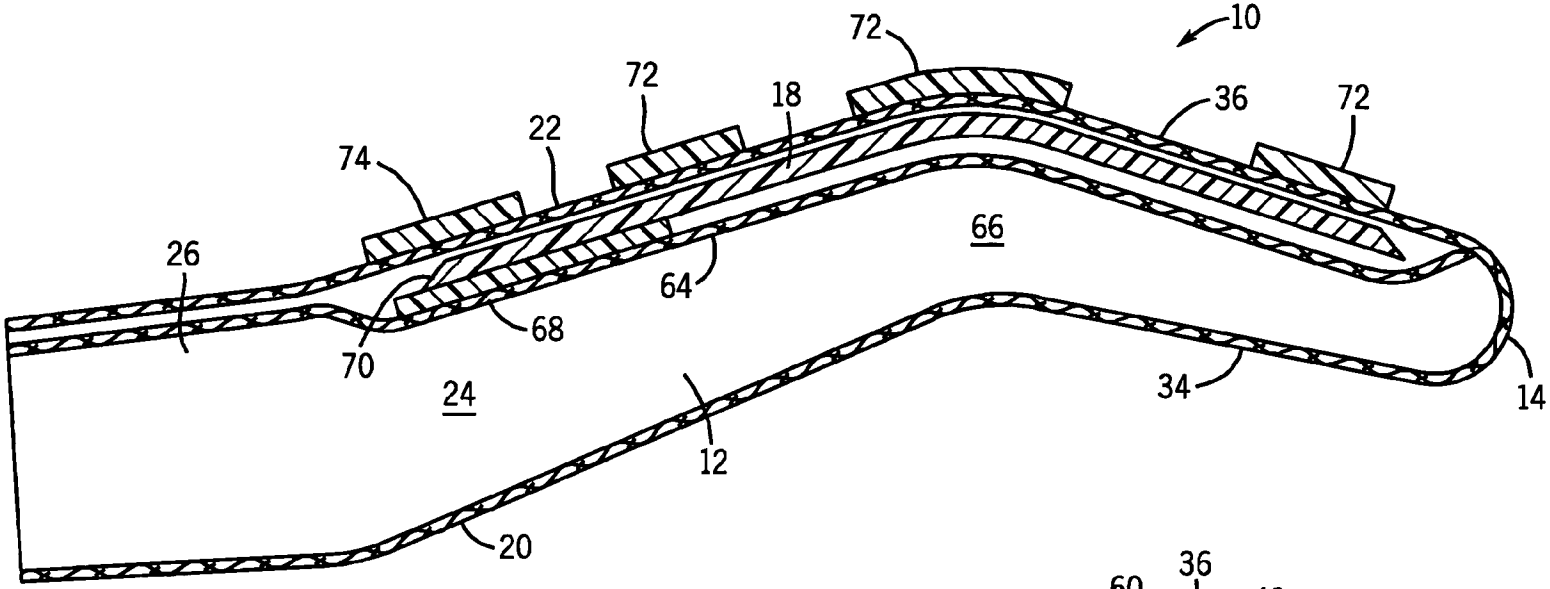
FIG. 3 is a cross sectional view along line 3-3 of FIG. 2.
Figure 4:
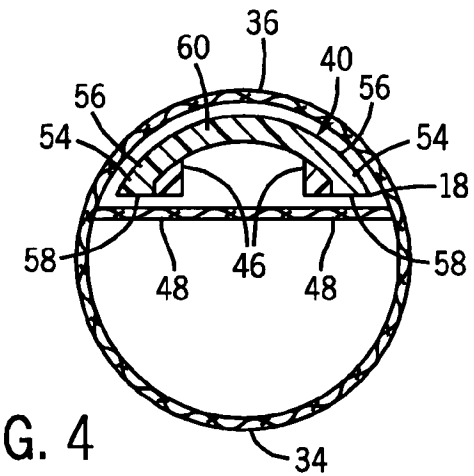
FIG. 4 is a cross sectional view along line 4-4 of FIG. 2.
Figure 5:
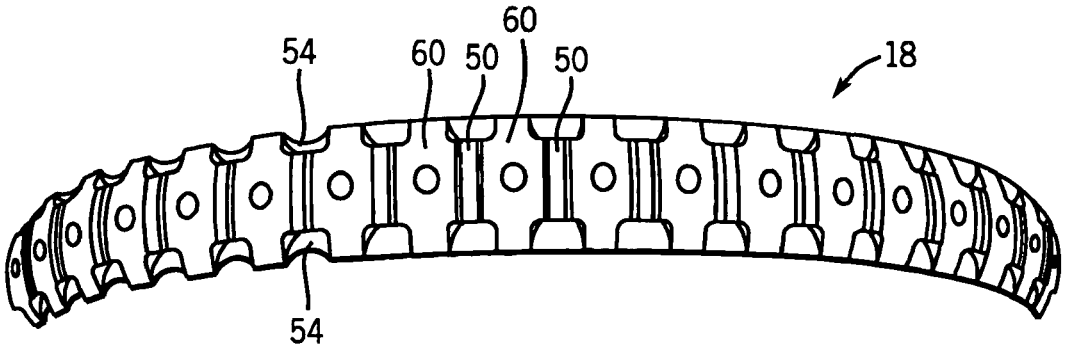
FIG. 5 is a top perspective view of the unidirectional stiffener of FIGS. 2-4.
Figure 6:
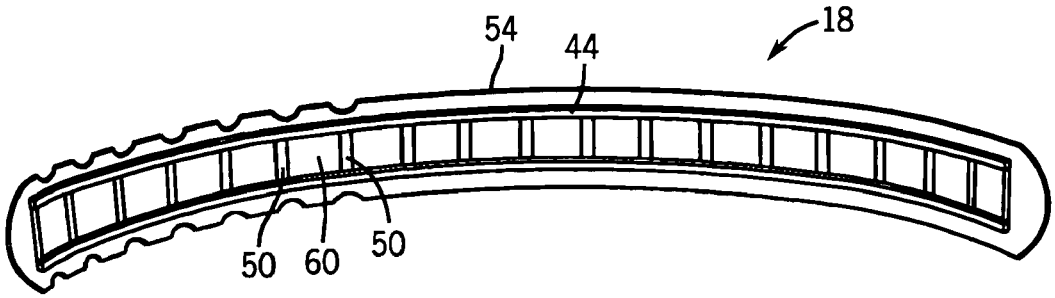
FIG. 6 is a bottom perspective view of the unidirectional stiffener of FIG. 5.
Figure 7:
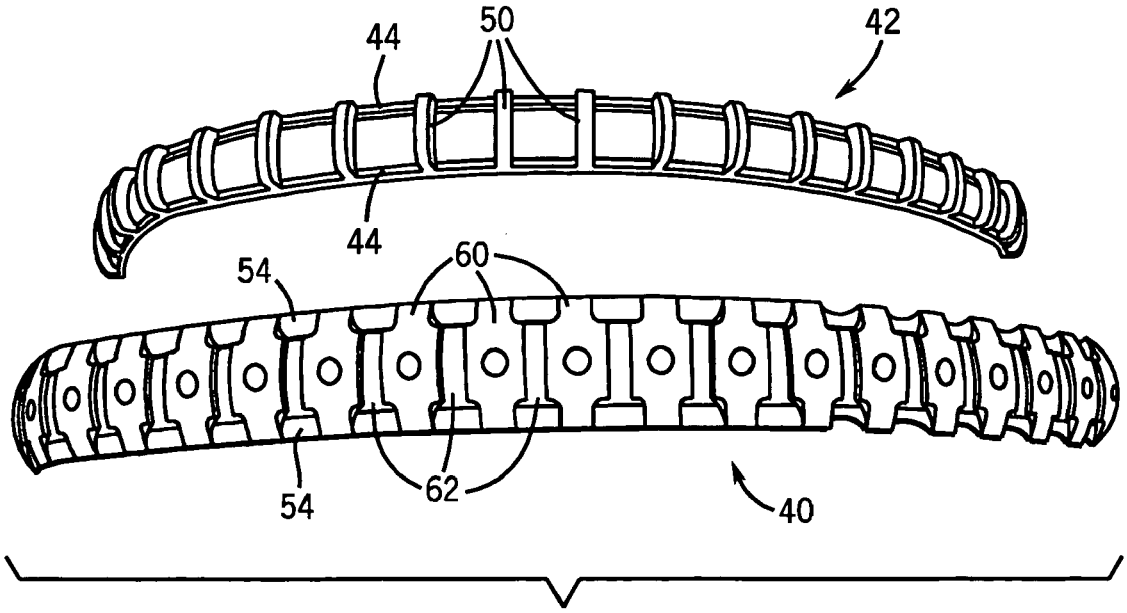
FIG. 7 is a top perspective view of the unidirectional stiffener of FIG. 5 in an unassembled state.

Each unidirectional stiffener 18 is fixed relative to, and extends along, one of the receptacles 14, 16 adjacent the receptacle back 36, such that the stiffener extends across the base and joints of the finger or thumb, and is bendable in only one direction. As shown in FIG. 2, each stiffener extends over the back of the user's hand to support the stiffener proximal ends 70 when the user's finger or thumb is urged toward a hyperextend position.

Each stiffener 18 adjacent one of the a finger receiving receptacles 14 allows the finger disposed in the finger receiving receptacle to bend toward the front 34 of the finger receiving receptacle 14 to allow the user's finger to flexion, or naturally curl toward the user's palm. Advantageously, the stiffener 18 is substantially rigid in the opposing direction to protect the finger from hyperextending (i.e. bending backwards toward the back of the user's hand) which can injure the finger. Likewise, the stiffener 18 adjacent the thumb receiving receptacle 16 allows the thumb disposed in the thumb receiving receptacle 16 to flexion and bend toward the front 34 of the thumb receiving receptacle 16 to allow the user's thumb to naturally curl toward the user's palm, and protect the thumb from bending backwards and hyperextending. Preferably, the stiffener also limits lateral movement (i.e. in the direction of adjacent fingers) to prevent injury by excess forced movement in the lateral directions.

In one embodiment, the stiffener 18 shown in FIGS. 4-7 is formed from upper and lower interlocking ladder structures 40, 42 that are snapped together to form the unidirectional stiffener 18. The lower ladder structure 40 includes a pair of parallel flexible sidebars 44 having a top 46 and a bottom 48. Evenly spaced rungs 50 joined to the top 46 of each lower ladder structure sidebar 44 join the lower ladder structure sidebars 44 together to form the lower ladder structure 40. Likewise, the upper ladder structure 42 includes a pair of parallel flexible sidebars 54 having a top 56 and a bottom 58. Evenly spaced rungs 60 joined to the top 56 of each upper ladder structure sidebar 54 join the upper ladder structure sidebars 54 together to form the upper ladder structure 42. Preferably, the lower ladder structure 40 is molded as an integral piece from plastic, such as polypropylene, polyethylene, and the like, and the upper ladder structure 42 is molded as an integral piece from plastic.

The upper ladder structure rungs 60 are spaced along the upper ladder structure sidebars 54 to form evenly spaced gaps 62 therebetween for receiving the lower ladder structure rungs 50. The upper ladder sidebars 54 are spaced further apart (i.e. have longer rungs) than the lower ladder structure sidebars 44, such that the lower ladder structure sidebars 44 fit between the upper ladder structure sidebars 54 and the bottoms 48, 58 of the sidebars 44, 54 are substantially even when the lower ladder structure rungs 50 are interdigitated with the upper ladder structure rungs 60.

When the lower ladder structure 40 is snapped together with the upper ladder structure 42, such that the rungs 50, 60 are interdigitated and the bottoms 48, 58 of the sidebars 44, 54 are substantially even, the sidebars 44, 54 can only bend in one direction around an axis below the bottom 48, 58 of the sidebars 44, 54. Bending the sidebars 44, 54 in an opposite direction around an axis above the top 46, 56 of the sidebars 44, 54 is prevented by the interdigitated rungs 50, 60 which engage each other to prevent the opposite direction bending. Advantageously, the width of the rungs 50, 60, can be sized to prevent the sidebars 44, 54 from being straightened or to allow a permissible degree of back flexing in the in the assembled stiffener 18. In the embodiment shown in FIGS. 5-7, the sidebars 44, 54 are molded to have an initial curl, however, an initial curl is not necessary to practice the invention.

Each stiffener 18 is fixed relative to one of the receptacles 14, 16 adjacent the back 36 of the respective receptacle 14, 16. Preferably, the stiffener 18 is fixed relative to the receptacle 14, 16 by a liner 64 sewn to the receptacle back 36 over the stiffener 18. The liner 64 secures the stiffener 18 adjacent the back 36 of the receptacle 14, 16. Of course, the stiffener 18 can be fixed relative to the respective receptacles 14, 16 using other methods known in the art, such as by mechanical fasteners, chemical bonding, wedging the stiffener between the finger and finger receiving receptacle inside the finger receiving receptacle, and the like.

The liner 64 is interposed between the stiffener 18 and the interior 66 of each receptacle 14, 16 and the hand covering portion cavity 24, and separates the stiffener 18 from the user's hand, fingers, and thumb. The liner 64 is formed from any known material, such as disclosed above, and allows the easy insertion of the user's hand, fingers, and thumb into the glove 10 without snagging the stiffener 18. Preferably, the liner 64 is fixed to the receptacle backs 36 and back hand cover 22 using methods known in the art, such as sewing, to fix the stiffeners 18 relative to the receptacles 14, 16.

Padding 68 interposed between the proximal end 70 of the stiffeners 18 and the liner 64 cushions forces exerted by the stiffeners 18 onto the back of the user's hand as the user's fingers are pushed backwards. The padding 68 can be formed from any cushioning material, such as neoprene, and the like. Of course, any material which can distribute forces from the stiffeners across the back of the hand, such as rigid plastic, leather, synthetic leather, foam, and the like, can be used without departing from the scope of the invention. Although the padding 68 shown in FIG. 2 is not shown to extend between the stiffener 18 fixed to the thumb receiving receptacle 16 and the liner 64, the padding 68, or another piece of padding, can be provided between the stiffener 18 fixed to the thumb receiving receptacle 16 and the liner 64 without departing from the scope of the invention.

In the embodiment disclosed herein, protection padding 72 is provided to protect the user's finger and thumb joints (i.e. metacarpophalangeal joint, proximal interphalangeal joint, distal interphalangeal joint, and thumb interphalangeal joint). The padding 72 comprises patches of material, such as described above, which is fixed to the receptacle backs 36 over the approximate location of the user's finger and thumb joints. The protection padding 72 provides additional protection to the user's finger and thumb joints. Additional protection padding 74 is fixed to the back hand cover 22 to protect the back of the user's hand and strengthen the back hand cover 22 adjacent the proximal end 70 of the stiffeners 18.

In use, a football player inserts each hand, fingers, and thumb, into the glove 10 through the wrist support portion 26 of the hand covering portion 12, such that each of the player's fingers is received in one of the finger receiving receptacles 14 and the player's thumb is received in the thumb receiving receptacle 16. A football player wearing the gloves 10 blocks or tackles an opponent by pushing the opponent with one or more of his hands in a desired direction. By football rule, an offensive player's hands must be open (i.e. not in a clenched fist configuration) when blocking. If the opponent attempts to thwart the efforts of the player by pushing the player's hands away, the stiffeners 18 in the gloves 10 prevent the player's fingers and/or thumb from being pushed too far backwards, and thus hyperextending the fingers and/or thumb causing injury.

While playing football, the rules allow a player to grasp an object, such as another player carrying the football, the football, and the like. The stiffeners 18 fixed adjacent the finger and thumb receiving receptacle backs 36 curl forwardly to allow the player to grasp the desired object. Curling the stiffener 18 is accomplished by the natural movement of player's fingers which bend the stiffener sidebars 44, 54 around the axis below the bottom 48, 58 of the sidebars 44, 54.

Figure 8:
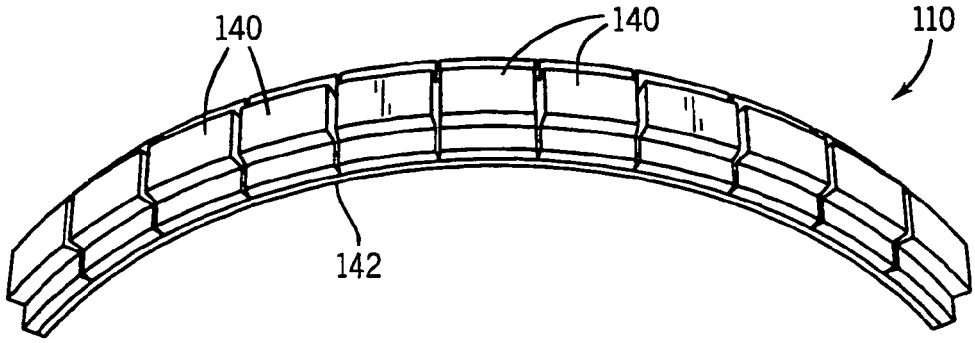
FIG. 8 is a top perspective view of an alternative embodiment of the unidirectional stiffener for use in a football glove incorporating the present invention.
Figure 9:
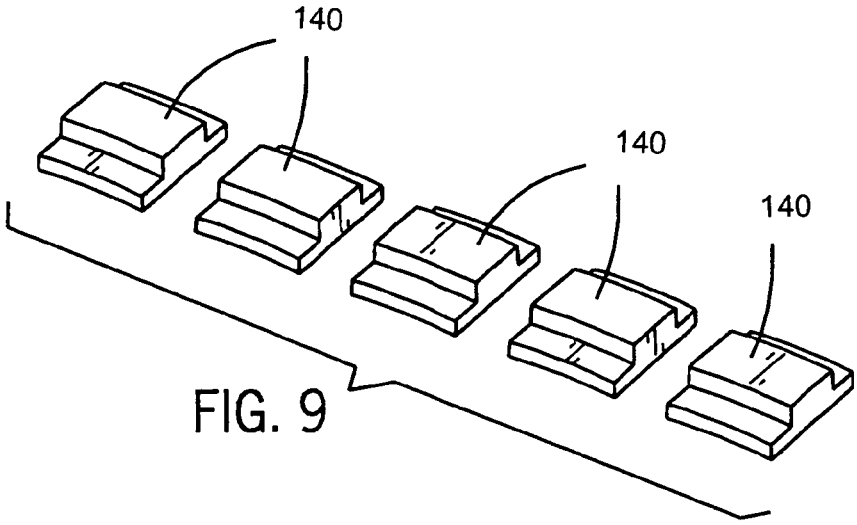
FIG. 9 a top perspective view of blocks of the stiffener of FIG. 8.
Figure 10:
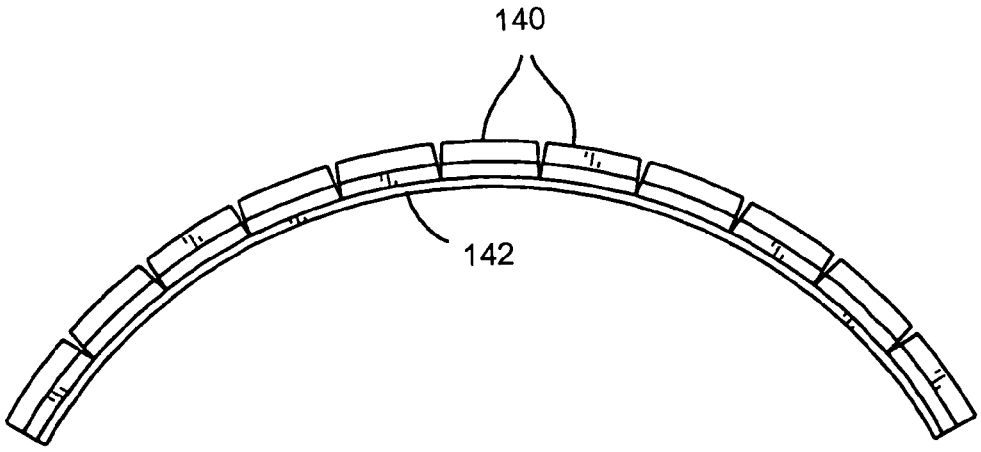
FIG. 10 is a side view of the stiffener of FIG. 8.

An alternative single piece stiffener 110, such as shown in FIGS. 8-10, can be used in a football glove incorporating the present invention. The stiffener 110 is formed by securing adjacent blocks 140, such as formed from plastic or other rigid material, to a vinyl strip 142. The sections of plastic blocks 140 are secured to the vinyl strip 142 using methods known in the art, such as ultrasonic welding, adhesives, and the like. The blocks 140 separate as the vinyl strip 142 is bent in a direction away from the blocks 140, as shown in FIG. 10, to allow a user's finger to flexion. The blocks 140 are forced together as the vinyl strip 142 is bent in a direction toward the blocks, as shown in FIG. 8, to prevent a user's fingers from hyperextending.

In yet another embodiment, the blocks 140 are joined together by a wire which passes through holes formed in each end of each block 140. Advantageously, by forming a stiffener using adjacent blocks 140 joined together by a vinyl strip or wires, the resulting stiffener is a single piece.

While there has been shown and described what are at present considered the preferred embodiment of the invention, it will be obvious to those skilled in the art that various changes and modifications can be made therein without departing from the scope of the invention defined by the appended claims. Therefore, various alternatives and embodiments are contemplated as being within the scope of the following claims particularly pointing out and distinctly claiming the subject matter regarded as the invention.

We claim:

1. A football glove for preventing hyperextension of fingers, said football glove comprising:

a hand covering portion for covering a palm and back of a user's hand;

a plurality of form fitting finger receiving receptacles extending from said hand covering portion, and in communication with said hand covering portion, each of said finger receiving receptacles includes a front and a back for receiving therebetween a finger of the user's hand covered by said hand covering portion;

a unidirectional stiffener having an upper interlocking ladder section having a first set of flexible sidebars joined together by rungs, and a lower interlocking ladder section having a second set of flexible sidebars joined together by rungs, with the upper interlocking ladder section and lower interlocking ladder section snapped together in a common plane with interdigitated rungs, fixed relative to at least one of said finger receiving receptacles adjacent said back of said at least one finger receiving receptacle extends toward said hand covering portion, wherein said unidirectional stiffener is bendable toward said front of said at least one finger receiving receptacle to allow the user's finger to naturally curl toward the user's palm and is substantially rigid in an opposing direction to prevent hyperextension of the user's finger.

2. The football glove of claim 1, in which a thumb receiving receptacle extends from said hand covering portion, and is communication with said hand covering portion for receiving the user's thumb.

3. The football glove of claim 2, in which a unidirectional stiffener extends into the receptacle receiving the user's thumb.

4. The football glove of claim 1, in which said hand covering portion includes a palm covering including a tacky material facing away from the user's palm received in the hand covering portion.

5. The football glove of claim 1, in which a wrist support extends from said hand covering portion which can wrap around the user's wrist extending from the user's hand received in said hand covering portion.

6. The football glove of claim 1, in which a liner joined to hand covering portion and said one of said finger receiving receptacle separates said stiffener from the user's hand.

7. The football glove of claim 1, in which said stiffener includes upper and lower interlocking ladder structures.

8. The football glove of claim 1 including padding fixed to at least one of said finger receiving receptacles proximal a location covering a finger joint of the user.

9. The football glove of claim 1, in which a pad engages an end of said stiffener to cushion a force exerted on the user's hand by said stiffener.

10. A method of using a football glove, said method comprising:

slipping a football player's hand into a football glove having receptacles for receiving fingers and a thumb of the football player's hand, wherein a unidirectional stiffener having an upper interlocking ladder section having a first set of flexible sidebars joined together by rungs, and a lower interlocking ladder section having a second set of flexible sidebars joined together by rungs, with the upper interlocking ladder section and lower interlocking ladder section snapped together in a common plane with interdigitated rungs, stiffens at least one of said receptacles when said receptacles are bent in a particular direction; and blocking an opposing player with the hand wearing the football glove, wherein the hand is open, and the unidirectional stiffener resists efforts by the opposing player to push the finger received in the at least one receptacle backwards toward a hyperextended position to prevent hyperextension of the football player's fingers received in the receptacles.

11. The method of claim 10, including grasping an object with the hand wearing the football glove by natural bending the fingers and thumb received in the receptacles, wherein the unidirectional stiffener curls in the direction of the bending finger received in said at least one receptacle.

12. The method as in claim 10, in which said football glove includes a hand covering portion, and said receptacles extend from said hand covering portion, and are in communication with said hand covering portion.

13. The method as in claim 12, in which in which the receptacle receiving the football player's thumb extends from said hand covering portion, and is communication with said hand covering portion for receiving the user's thumb.

14. The method as in claim 12, in which a wrist support extends from said hand covering portion which can wrap around the football player's wrist extending from the football player's hand received in said hand covering portion.

15. The method as in claim 12, in which a liner is joined to said hand covering portion and said at least one receptacle to separate said stiffener from the football player's hand.

16. The method as in claim 10, in which said stiffener includes upper and lower interlocking ladder structures.

17. The method as in claim 10, in which said receptacles receiving the football player's fingers are form fitting to fix the stiffener relative to the football player's finger receiving in said at least one receptacle.

18. The method as in claim 10, in which a unidirectional stiffener extends into the receptacle receiving the user's thumb.

19. The method as in claim 10 including padding fixed to at least one of said receptacles proximal a location covering a finger joint of the user.

20. The method as in claim 10, in which a pad engages an end of said stiffener to cushion a force exerted on the user's hand by said stiffener.

* * * * *